United States Patent [19]

Heinzle

[11] 4,033,547

[45] July 5, 1977

[54] FORM FOR POURING CONICALLY TAPERING CONCRETE STRUCTURES

[76] Inventor: Otto Heinzle, Sonderberg 19, A-6840-Gotzis (Vorarlberg), Austria

[22] Filed: Nov. 7, 1975

[21] Appl. No.: 630,036

[30] Foreign Application Priority Data

Nov. 8, 1974 Austria ..... 8986/74

[52] U.S. Cl. ..... 249/193; 249/17; 249/19; 249/194; 403/178

[51] Int. Cl.[2] ..... E04G 11/04

[58] Field of Search ..... 249/1, 13, 17, 18, 27, 249/33, 34, 193, 165, 19, 194; 52/82, 758 AF; 403/174, 178

[56] References Cited

UNITED STATES PATENTS

| | | | |
|---|---|---|---|
| 811,032 | 1/1906 | Byor | 249/1 |
| 872,393 | 12/1907 | Votaw | 249/1 |
| 1,119,818 | 12/1914 | Gambsky | 249/27 |
| 1,219,272 | 3/1917 | Edison | 249/27 |
| 1,303,251 | 5/1919 | Brunner | 249/27 |
| 1,311,282 | 7/1919 | McKay | 249/193 |
| 1,958,076 | 5/1934 | Vincent | 249/193 |

FOREIGN PATENTS OR APPLICATIONS

| | | | |
|---|---|---|---|
| 590,294 | 7/1947 | United Kingdom | 52/82 |
| 318,951 | 9/1929 | United Kingdom | 52/82 |

*Primary Examiner*—Richard B. Lazarus
*Assistant Examiner*—John McQuade
*Attorney, Agent, or Firm*—Hans Berman

[57] ABSTRACT

A form for pouring a conical concrete structure has a framework of obliquely inclined beams radiating from the axis of the structure in angularly offset relationship. Circumferentially elongated connecting members connect each beam to the two angularly adjacent beams. They are spaced longitudinally of the beams and sequentially increase in length in a direction away from the axis. Threaded fasteners connect the longitudinally terminal portions of each connecting member to respective connected beams. Sheeting covers the connecting members and is fastened to the members to constitute a substantially conically tapering wall extending about the axis of the form in a closed loop.

7 Claims, 15 Drawing Figures

Fig. 8
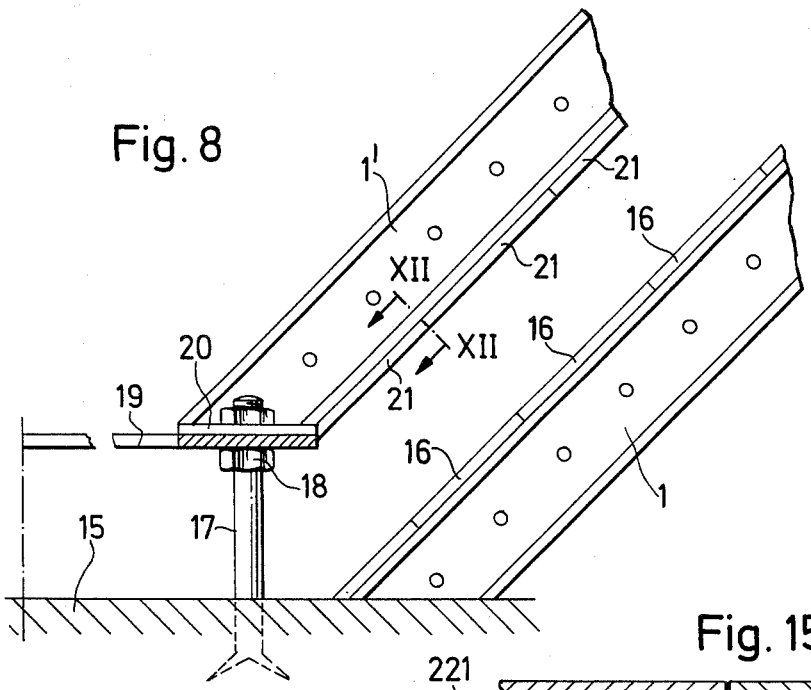
Fig. 15
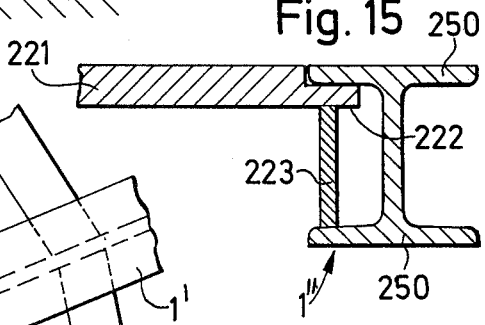
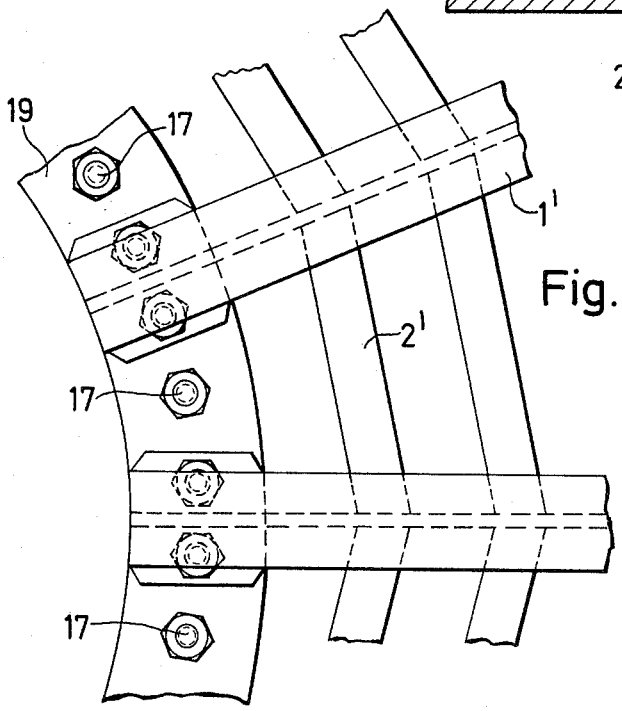
Fig. 9

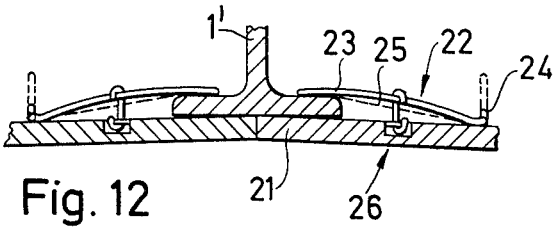
Fig. 12
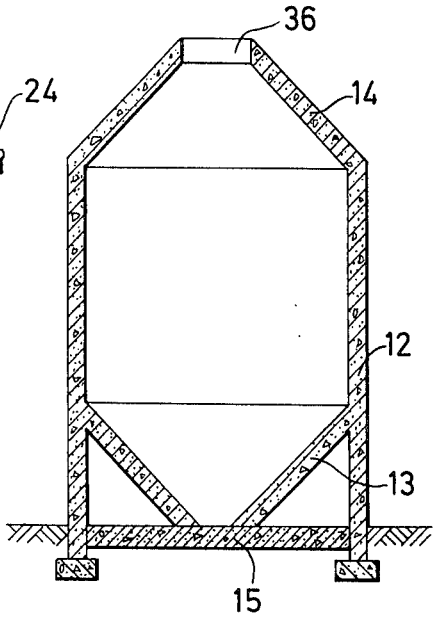
Fig. 10
Fig. 13
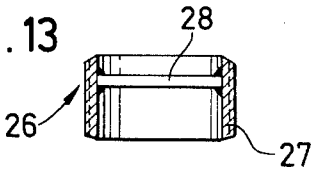
Fig. 14
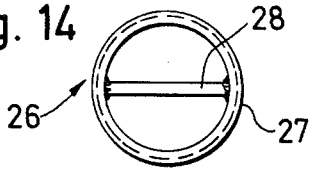
Fig. 11
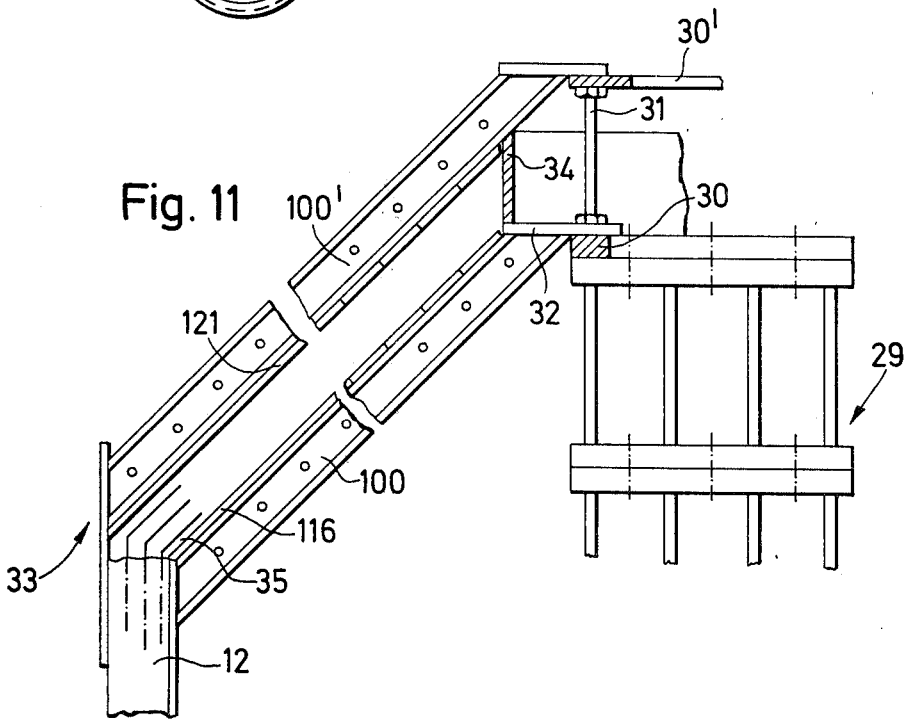

FORM FOR POURING CONICALLY TAPERING CONCRETE STRUCTURES

BACKGROUND OF THE INVENTION

This invention relates to forms for pouring conically tapering concrete structures, and particularly to a form releasably assembled from a framework of load bearing elongated members and sheeting fastened to the framework.

In known forms of the type described, the framework is assembled by means of nodes which are either complex and laborious to assemble or suitable only for small structures in which the sheeting itself can absorb a significant portion of the stresses caused by the weight of the fluid concrete mixture.

It is a primary object of the invention to provide a form for pouring a conically tapering concrete structure which is simple and inexpensive in its first cost, and from which even forms for very large structures can be assembled quickly with a minimal expenditure for labor. It is a concomitant object to provide a form whose framework is substantially self-supporting and requires little, if any shoring.

Yet another object is the provision of a form whose framework consists of elements manufactured from readily available commercial steel shapes in a simple manner.

BRIEF SUMMARY OF THE INVENTION

With these objects and others in view, as will hereinafter become apparent, the invention provides a form whose framework consists of beams, such as I-beams or T-beams of structural steel, connecting members, and threaded fasteners. The beams are obliquely inclined relative to the axis of the substantially conically tapering structure that it is desired to pour and whose shape is duplicated by the sheeting which covers the framework. The beams radiate longitudinally from the apex of the conical shape in angularly offset relationship. The connecting members are tension or compression members elongated circumferentially and connect each beam to the two angularly adjacent beams. The connecting members are spaced from each other longitudinally of the connected beams and sequentially increase in length in a direction away from the axis. The threaded fasteners connect the two longitudinally terminal portions of each connecting member to respective connected beams.

Other features, additional objects, and many of the attendant advantages of this invention will readily be appreciated as the same becomes better understood from the following detailed description of a preferred embodiment when considered in connection with the appended drawing.

BRIEF DESCRIPTION OF THE DRAWING

FIG. 8 is a fragmentary elevational section of a form including the two frameworks respectively shown in FIGS. 1–4 and 5–7;

FIG. 9 is a top plan view of the apparatus of FIG. 8;

FIG. 10 shows a concrete structure partly poured in the form of FIGS. 8 and 9;

FIG. 11 illustrates another part of the form employed for pouring the structure of FIG. 10 in a view corresponding to that of FIG. 8;

FIG. 12 shows a detail of the apparatus of FIG. 8 in section on the line XII—XII;

FIG. 13 is a greatly enlarged view of a detail of the apparatus of FIG. 12;

FIG. 14 shows the device of FIG. 13 in cross section; and

FIG. 15 illustrates another portion of the form of FIG. 8 in a view analogous to that of FIG. 12.

DESCRIPTION OF THE PREFERRED EMBODIMENTS

Figure 1:
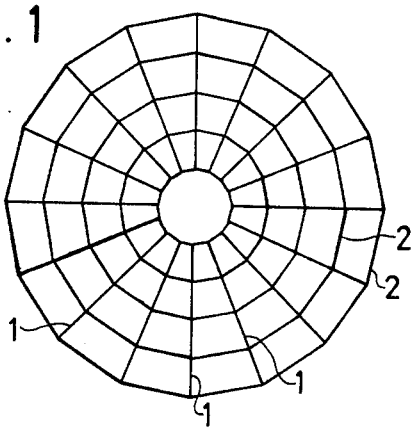
FIG. 1 shows a framework for a form of the invention in simplified top plan view, the beams and connecting tension members being represented by single lines.

Referring initially to FIG. 10, there is shown a tank of reinforced concrete which was poured in an actual embodiment of this invention. The tank has a cylindrical, upright wall 12 closed downwardly by a flat base plate 15. The actual tank bottom 13 tapers frustoconically from the wall 12 to the base plate 15. An analogous, frustoconical roof 14 tapers upward from the upper rim of the wall 12 to a central opening 36 in the roof. The forms employed for pouring the base plate 15 and wall 12 were conventional and will not be described in detail. This invention is concerned with the forms employed for pouring the conically tapering, hollow, conical structures 13, 14.

The framework for the form in which the tank bottom 14 was poured is shown in FIG. 1. It consists essentially of 16 I-beams 1 which are obliquely inclined relative to the tank axis and radiate longitudinally from a common apex in the tank axis in equiangularly offset relationship. Five rows of 16 connecting members 2, each elongated in a circumferential direction and aligned with adjacent connecting members of the same row, connect each beam 1 to two angularly adjacent beams. The rows are spaced from each other longitudinally of the connected beams, and the rows and their constituent connecting members sequentially increase in length in a direction away from the axis.

Figure 4:
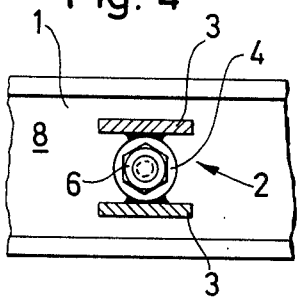
FIG. 4 is a sectional view of the device of FIG. 3 taken on the line IV—IV.
Figure 3:
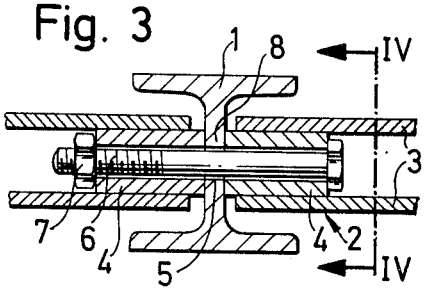
FIG. 3 shows the node of FIG. 2 in section on the line III—III.
Figure 2:
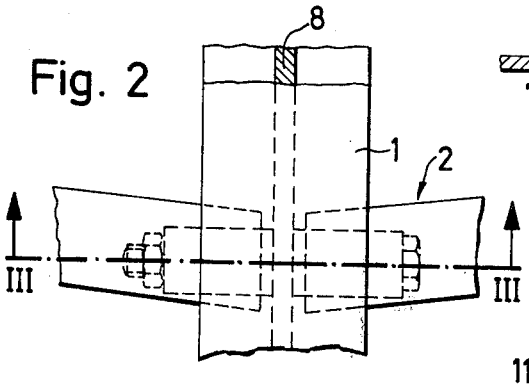
FIG. 2 illustrates a node in the framework of FIG. 1 on a greatly enlarged scale and partly in section.

FIGS. 2 to 4 show one of the nodes constituted in FIG. 1 by a beam 1 and two aligned connecting members 2. Each connecting member consists of two flat, identical steel bars 3 elongated in a common direction in transversely spaced relationship and two sleeves 4. Each sleeve 4 is interposed between a pair of longitudinal end portions of the bars 3 and welded to the end portions in such a manner that the axis of each sleeve bore is offset at the same, small, acute angle from the direction of elongation of the connecting member.

The two sleeves 4 seen in FIGS. 2 and 3 abut against the web 8 of the associated I-beam 1 from opposite sides, and the axes of their bores are aligned with each other and with an opening 5 in the web. A bolt 6 of high strength steel passes through the aligned bores and opening. The head of the bolt abuts against the distal end face of one sleeve 4, and a nut 7 on the bolt 6 abuts against the corresponding end face of the other sleeve, thereby fixedly, but releasably securing the connecting members 2 to the beam. The node structure of FIGS. 2 to 4 is duplicated 80 times in the framework illustrated in FIG. 1.

As is seen in FIG. 8, the framework including the beams 1 carried coaxial rows of sheeting panels 16 on which the weight of the fluid concrete mixture will rest during and after pouring of the mixture into the form partly shown in FIG. 8. The opposite form wall is constituted by analogous rows of sheeting panels 21 mounted on another framework of beams 1′ and connecting members 2′ stressed in compression, the framework being identical with that of FIG. 1 when viewed on the scale of FIG. 1.

Figure 5:
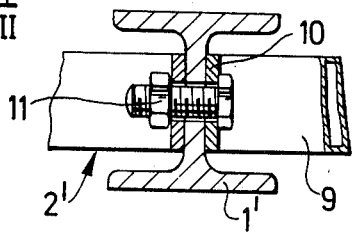
FIGS. 5, 6, and 7 illustrate a node in a framework analogous to that of FIG. 1, but having connecting members stressed in compression, in respective view corresponding to FIGS. 3, 4, and 2 respectively.
Figure 7:
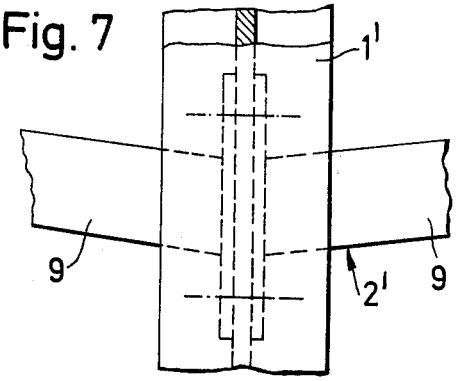
Figure 6:
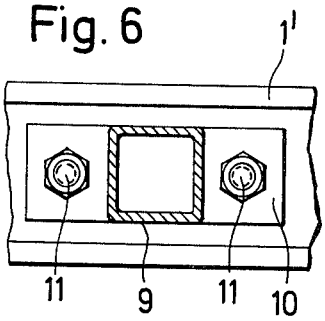

As is apparent from the enlarged views of FIGS. 5 to 7, the nodes of the other framework are structurally different to accomodate the different stresses in the main portions 9 of the connecting members 2′ which are square steel tubes. The ends of each tube 9 are cut off at the same angle to the direction of tube elongation, and a flange plate 10 is welded to the parallel end face of the tube. Two bolts 11 pass through aligned bores of two flange plates 10 engaging opposite faces of the interposed web of the beam 1′ and through openings in the web.

Reverting to FIGS. 8 and 9, there are shown three of the 16 upright rods 17 embedded in the base plate 15 during pouring of the latter. The upper end of each rod 17 is threaded, and two nuts 18 secure therebetween a flat, annular mounting disc 19 connecting the several rods 17. A flange plate 20 welded to the end face of each obliquely cut beam 1′ is bolted to the mounting plate 19. The other ends of the beams 1′ , not themselves seen in FIGS. 8 and 9, rest against the inner face of the cylindrical wall 12 in a manner not explicitly shown. The lower ends of the beams 1 similarly rest against the base plate 15.

The form for pouring the roof 14 is shown in FIG. 11 and is closely similar to the structure illustrated in FIGS. 8 and 9 though tapering conically in an upward direction. Pouring of the cylindrical wall 12 is completed before the framework for the roof form is assembled. It consists of two sets of I-beams 100, 100′ arranged and connected in the manner described above with reference to the beams 1, 1′, the respective connecting members being omitted from the showing of FIG. 11 as they are omitted from FIG. 8. Sheeting panels 116, 121 are attached to the framework as will presently be described.

Flange plates 32 welded to the upper end faces of each of the beams 100, 100′ extend in two horizontal planes and are fastened to flat rings 30, 30′ by 16 upright threaded rods 31 and necessary nuts. The lower ring 30 is supported on an auxiliary column 29 standing on the center of the base plate 15. The lower ends of the beams 100, 100′ carry flange plates omitted from FIG. 11, but not significantly different from the plates 20 shown in FIGS. 8 and 9, though standing upright. They fasten the lower ends of the beams to two cylindrical rings 33 extending about the upper rim on the outside and inside of the cylindrical wall 12. Reinforcing iron rods 35 are seen in FIG. 11 to extend into the form cavity for the roof 14, and it will be understood that such reinforcement is provided conventionally throughout the forms shown in FIGS. 8, 9, and 11.

The sheeting panels 21, 121 are suspended from the associated I-beams 1′, 101′ in a manner shown in detail in FIGS. 12 to 14 with reference to beams 1′. The width of the panels is equal to the circumferential, center-to-center spacing of the associated beams 1′. The edges of the panels therefore converge toward the apex of the conical surface which their combined outer faces approximate. The butt seam between circumferentially adjacent panels is radially aligned with the web of the associated I-beam. Each panel 21 is suspended from the I-beam 1′ by two or more steel wires 22 longitudinally spaced along the beam.

As is best been seen in FIG. 12, each wire is approximately L-shaped, and its two legs 23, 24 are arcuate when in the relaxed condition. An S-shaped wire hook 25 attaches the wire 22 to a socket 26 in the panel 21. As is better seen in FIGS. 13 and 14, the socket is a short nipple whose external threads 27 engage internal threads in a conforming blind bore of the panel 21, and which is provided in its bore with a diametrically fastened rod 28. In mounting each panel, the two legs 23, 24 of a wire 22 are placed respectively on the flange of the beam 1′ and on the inner face of the panel 21, and the center of the longer leg 23 is bent toward the panel, as indicated by a broken line, until the hook 25 can be slipped over the wire 22 and the rod 28. When the wire is released, it assumes the fully drawn shape, and resiliently holds the panel 21 against the flange of the I-beam 1′. The panels 16, 116 may be fastened in the same manner to the beams 1, but they lend themselves particularly well to a fastening method illustrated in FIG. 15 with reference to a beam 1″ and modified panels 221 associated therewith. The panels have rabbeted edge portions, each rabbet or recess being dimensioned to receive one of the flanges 250 of the beam 1″ so that the outer faces of the flange 250 and of the panel 221 are flush in the conical surface of the form. Locking rods 223 are wedged between the edge portion of the panel and the other flange 250 of the beam 1″.

In constructing the tank shown in FIG. 10 which had an internal diameter of eight meters and proportional other dimensions as seen in FIG. 10, the base plate 15 and the lower portion of the cylindrical wall 12 were built first, and the framework of the form for the tank bottom 13 and necessary reinforcing metal were then installed. Panels 16, 21 were affixed in circular rows, and each completed annular form portion was filled with concrete mixture before the next higher row of panels was mounted. The remainder of the cylindrical wall 12 then was poured and the conical roof 14 built in a manner analogous to the construction of the bottom 13. When the concrete was cured, the form was disassembled and removed, access to the annular space between the bottom 13, the wall 12, and the plate 15 being had through access openings in the wall 12, not shown.

Plywood panels were employed in the illustrated form of the invention, but the materials of construction employed and their specific shapes are not critically important if they satisfy specific requirements for the task at hand. The steel I-beams 1, 1″, 100, 100′ thus may be replaced by T-beams of the same metal, and the beams may be of wood under suitable conditions.

The threaded fasteners which make the framework of beams and connecting members self-supporting and load-sustaining are essential to the success of the invention in that they permit transmission of the high tensile and compressive stresses which need to be absorbed by the framework of the form during and after pouring until the concrete cures. However, threaded fasteners other than those specifically described may be substituted.

It should be understood, therefore, that the foregoing disclosure relates only to a preferred embodiment, and that it is intended to cover all changes and modifications of the example of the invention herein chosen for the purpose of the disclosure which do not constitute departures from the spirit and scope of the invention set forth in the appended claims.

I claim:

1. A form for pouring a concrete structure having an axis and substantially conically tapering in the direction of said axis comprising:

a. a plurality of elongated beam members obliquely inclined relative to said axis and radiating longitudinally in a direction from a common point in said axis in angularly offset relationship;

b. a plurality of connecting members, elongated in a circumferential direction and connecting each of said beam members to the two angularly adjacent beam members, 1. said connecting members being spaced from each other longitudinally of the connected beam members and sequentially increasing in length in a direction away from said axis, 2. each connecting member including two longitudinally elongated, longitudinally coextensive, transversely spaced elements and two sleeve members transversely interposed between respective pairs of longitudinally terminal end portions of said elements in fixed spatial relationship, 3. said sleeve members having each an axis and being formed with an axial bore, the axis of the bore in each sleeve member being angularly offset from the axis of the bore in the other sleeve member and from the direction of elongation of said connecting member;

c. threaded fasteners connecting the two longitudinally terminal portions of each connecting member to respective connected beam members, one of said threaded fasteners being received in the bore of each sleeve member; and d. sheeting covering said connecting members and fastened to said beam members to constitute a substantially conically tapering wall extending about said axis in a closed loop.

2. A form as set forth in claim 1, wherein each connecting member connecting one of said beam members to an angularly adjacent beam member is longitudinally aligned with another connecting member connecting said one beam member to another angularly adjacent beam member.

3. A form as set forth in claim 1, wherein the angles defined by said direction of elongation and the respective axes of said sleeve members are acute and substantially identical.

4. A form as set forth in claim 3, wherein each beam member is formed with an opening extending transversely therethrough and connecting the bores of two sleeve members of respective connecting members, one of said threaded fasteners passing sequentially through one of said bores, said opening, and the other bore.

5. A form as set forth in claim 1, wherein each beam member has a transverse planar end face obliquely inclined relative to the direction of elongation thereof, said form further comprising a fastening plate fixedly fastened to each end face in a plane parallel to said end face, an annular mounting member centered in said axis, and securing means securing each fastening plate to said mounting member.

6. A form as set forth in claim 1, wherein each of said beam members is of T-shaped cross section and has two flanges connected by a web, said sheeting includes a plurality of panels having each two angularly converging edge portions, one edge portion being formed with an elongated recess receiving one flange of one of said beam members, and a backing member interposed between said edge portion and the other flange of said one beam member in abutting engagement and thereby securing said panel to said one beam member.

7. A form as set forth in claim 6, wherein said one flange and the panel receiving said one flange in the recess thereof have respective outer faces located substantially in a common, conically tapering surface.

* * * * *